US007497398B2

(12) United States Patent
Mehrer

(10) Patent No.: US 7,497,398 B2
(45) Date of Patent: Mar. 3, 2009

(54) STRAP ROLL UP DEVICE

(76) Inventor: Donald Mehrer, 306 Shadow Hill La., Wright, WY (US) 82732

( * ) Notice: Subject to any disclaimer, the term of this patent is extended or adjusted under 35 U.S.C. 154(b) by 122 days.

(21) Appl. No.: 11/540,260

(22) Filed: Sep. 29, 2006

(65) Prior Publication Data

US 2007/0075177 A1 Apr. 5, 2007

Related U.S. Application Data

(60) Provisional application No. 60/723,321, filed on Oct. 3, 2005.

(51) Int. Cl.
*B65H 19/22* (2006.01)

(52) U.S. Cl. ..... 242/533; 242/539; 242/546.1; 242/532.6; 242/402; 100/9; 53/585

(58) Field of Classification Search ..... 242/395, 242/398, 402, 404, 404.2, 405, 405.3, 406, 242/532.5, 532.6, 585, 586, 587, 587.2, 588, 242/588.2, 597, 597.1, 597.2, 597.5, 597.8, 242/535, 539, 546.1, 520, 472.5, 580, 580.1; 100/2, 5, 9, 29, 30, 212; 53/585
See application file for complete search history.

(56) References Cited

U.S. PATENT DOCUMENTS

| | | | | | |
|---|---|---|---|---|---|
| D225,723 | S | * | 1/1973 | Hallowell | D8/359 |
| 3,954,226 | A | * | 5/1976 | Pickering | 242/395 |
| 4,311,288 | A | * | 1/1982 | Galland | 242/532.6 |
| 4,390,141 | A | * | 6/1983 | Webster | 242/404.2 |
| 4,475,698 | A | * | 10/1984 | Militello | 242/532.6 |
| D307,239 | S | * | 4/1990 | Topping | D8/359 |
| 5,188,307 | A | * | 2/1993 | Miller | 242/546.1 |
| 5,961,061 | A | * | 10/1999 | Stanley | 242/395 |
| 6,606,839 | B1 | * | 8/2003 | Suda et al. | 53/430 |
| 2003/0182979 | A1 | * | 10/2003 | Olson | 242/395 |
| 2007/0145179 | A1 | * | 6/2007 | Engelsher | 242/532.6 |

* cited by examiner

*Primary Examiner*—Peter M Cuomo
*Assistant Examiner*—William E Dondero
(74) *Attorney, Agent, or Firm*—Gene R. Woodle

(57) ABSTRACT

Embodiments of a strap roll up device are disclosed which may be used to conveniently roll up and secure tie down straps or other similar articles.

2 Claims, 2 Drawing Sheets

STRAP ROLL UP DEVICE

RELATED APPLICATIONS

This application relies for priority upon the Provisional Patent Application filed by Donald Mehrer entitled Strap Roll Up Device, Ser. No. 60/723,321, filed Oct. 3, 2005.

BACKGROUND OF THE INVENTION

1. Field of the Invention

The present invention relates generally to tie down straps and more specifically to a strap roll up device which provides a device for rolling up tie down straps and securing them in a convenient roll.

2. Background Information

In this country and around the world thousands of people use what are generally referred to a tie down straps every day. Such straps usually have hooks on both ends and often have some method of shortening or lengthening the straps to secure a load.

Most often after being used these straps are tossed into a box or other storage container. Invariably, the straps become tangled and twisted and are difficult to untangle the next time they are needed.

The strap roll up device of the instant invention is believed to solve, in a new and unique fashion, the above described problems relating to the used to tie down straps and any other type of strap. The straps roll up device has a method of securing the device to, for example, a pickup tail gate to provide stability for the device in use, a method of rolling up straps, and a built-in method of securing the rolled straps in a convenient bundle.

One of the major objects of the present invention is to provide a strap roll up device which may be used to roll up straps.

Another objective of the present invention is to provide a strap roll up device which secures the rolled up straps in a convenient bundle.

Another objective of the present invention is to provide a strap roll up device which may easily be removably affixed to an object to provide for stable operation of the device.

Another objective of the present invention is to provide a strap roll up device which is simple, safe, rugged, inexpensive, and easy to use.

These and other features of the invention will become apparent when taken in consideration with the following detailed description and the drawings.

SUMMARY OF THE INVENTION

The strap roll up device of the instant invention comprises an attachment section, a roll up section, and a tying section. The attachment section provides a method of removably affixing the strap roll up device to another object such as a pickup tail gate for stable operation. The roll up section provides a method for easily rolling straps into an elongated roll. The tying section provides a method for securing the rolled straps in the elongated roll.

The attachment section is, essentially, a clamp which may be used to removably affixed the instant invention to, for example, the tailgate of a pickup.

The roll up section includes a crank affixed to a plate. The plate includes a split pin on one end and a pin on the other end. The split pin includes a slot which may be used to removably secure the strap to the split pin. As the crank is turned, the strap winds up on the split pin and the pin to form an elongated roll.

The tying section includes a platform which is rotatably affixed to the plate. The platform may be preloaded with a plurality of rubber bands or similar elastic devices which are affixed to the platform by a plurality of band pins. After the strap has been rolled up, the platform may be rotated until it is at a ninety degree angle to the rolled up strap. One of the rubber bands may then be released from the platform and the rubber band secures the rolled up strap. The rolled up strap with the rubber band may then be removed from the strap roll up device and stored as desired.

Although the strap roll up device of the instant invention is described as being used for rolling up and securing tie down straps and this is the preferred embodiment of the invention, the strap roll up device could be easily adapted to roll up and secure any number of other long thin objects including extension cords and hoses.

DESCRIPTION OF A PREFERRED EMBODIMENT

Figure 1:
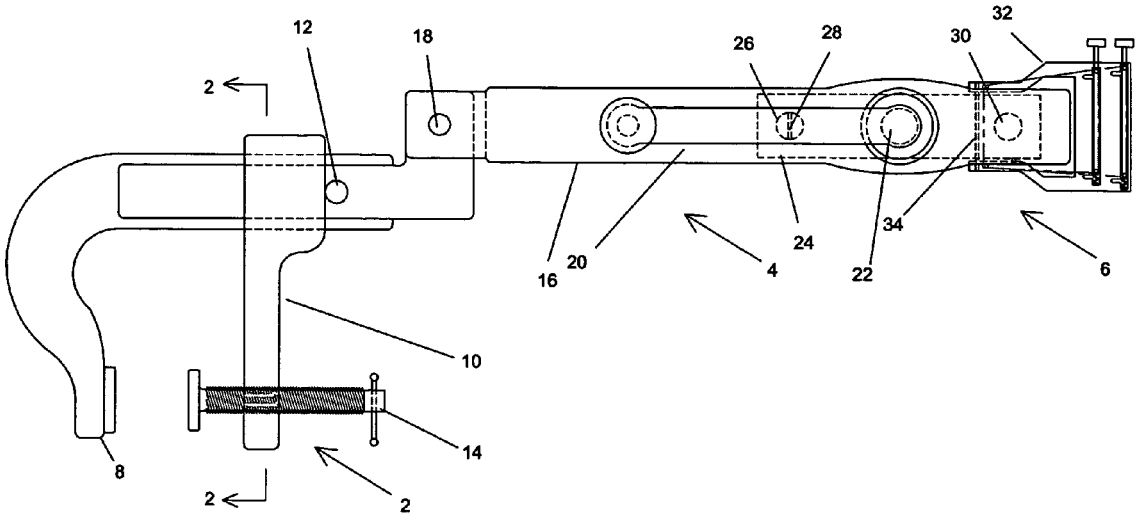
FIG. 1 is a side view of the strap roll up device of the instant invention.

Referring to the drawings, FIGS. 1 through 6, a preferred embodiment of the strap roll up device of the instant invention is shown.

Referring now to FIG. 1, the strap roll up device of the instant invention may be divided into an attachment section 2, a roll up section 4, and a tying section 6. The attachment section 2 may be used to removably affixed the instant invention to, for example, the tailgate of a pickup for stable operation of the device. The roll up section 4 provides a method for easily rolling up a strap into an elongated roll. The tying section 6 provides a method for securing the rolled up straps in the elongated roll. For purposes of the following description, said attachment section 2 is considered to be at the forward end of the device and the tying section 6 is considered to be at the rearward end of the device.

Still referring to FIG. 1, said attachment section 2 includes a forward clamp 8 which has the general shape of an "L" with the shorter leg extending downward and the longer leg extending rearward. A rearward clamp 10 is slidably affixed to the longer leg of the forward clamp 8 and extends downward. A stop 12 protrudes from said forward clamp 8 rearward of the rearward clamp 10 and prevents said rearward clamp 10 from sliding rearward passed the stop 12. A screw 14 is rotatably affixed near the bottom of said rearward clamp 10 such that it opposes the bottom of said forward clamp 8. The bottom of said forward clamp 8 and the screw 14 may be placed over an object, such as the tailgate of a pickup, such that the bottom of said forward clamp 8 is on one side of the object and said screw 14 is on the other side of the object. Said screw 14 may be turned such that said rearward clamp 10 slides rearward until it contacts the stop 12. Turning said screw 14 slightly further causes the bottom of said forward clamp 8 and the forward end of said screw 14 to contact the object and removably affixes the strap roll up device to the object.

Still referring to FIG. 1, the roll up section 4 includes a roll up plate 16 which is rotatably affixed to the rearward end of said forward clamp 8 by a roll up pin 18. A crank 20 is rotatably affixed to the roll up plate 16 by means of and axle 22 which passes through a hole in the rearward end of said roll up plate 16. A plate 24 is affixed to the other end of the axle 22 such that turning the crank 20 causes the plate 24 to turn. A split pin 26 protrudes from the forward end of said plate 24. The split pin 26 includes a slot 28 through the length of said split pin 26 and is slightly narrower than the thickness of the strap to be rolled up. A pin 30 protrudes from the rearward end of said plate 24. Said tying section 6 includes a platform 32 which is rotatably affixed to the rearward end of said plate 24 by a platform pin 34 which passes through said plate 24 forward of the pin 30.

Figure 2:
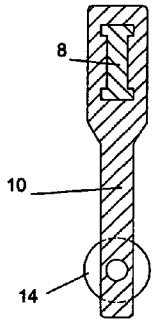
FIG. 2 is a partial sectional view of the strap roll up device of the instant invention taken along line 2-2 of FIG. 1.

Referring now to FIG. 2, a partial sectional view of the strap roll up device of the instant invention taken along line 2-2 of FIG. 1 is shown. This view shows that the upper portion of said rearward clamp 10 is hollow such that it fits around said forward clamp 8. The cross section of this portion of said forward clamp 8 is shaped such that said rearward clamp 10 may slide along the length of said forward clamp 8, but may not rotate about the longitudinal axis of said forward clamp 8. This insures the stability of the device when affixed to an object by screwing said screw 14 as described above.

Figure 3:
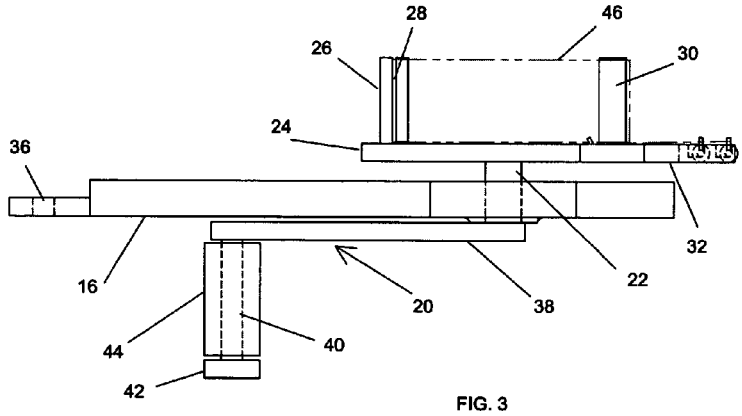
FIG. 3 is a top view of roll up section and the tying section of the strap roll up device of the instant invention.

Referring now to FIG. 3, a top view of roll up section 4 and the tying section 6 of the strap roll up device of the instant invention is shown. This view shows a hole 36 which is used to secure said roll up plate 16 to said forward clamp 8 using said roll up pin 18 (not shown in this view). Said crank 20 includes a shank 38 which is affixed to said axle 22. A crank pin 40 protrudes from the end of the shank 38 not affixed to said axle 22. A crank stop 42 is affixed to the end of the crank pin 40. A handle 44 is rotatably affixed to said crank pin 40 and prevented from sliding off of said crank pin 40 by the crank stop 42. Thus, when said crank 20 is turned to rotate said axle 22, using the handle 44; said handle 44 rotates about said crank pin 40. Because said plate 24 is also connected to said axle 22, turning said crank 20 also turns said plate 24. The end of a strap 46 (not considered a part of the instant invention) may be affixed to said split pin 26 by forcing the end of the strap 46 into said slot 28. The rest of said strap 46 is draped over said pin 30. When said crank 20 is turned, said strap 46 rolls up on said split pin 26 and said pin 30 creating an elongated roll. As may be seen in this view, said platform 32 is aligned with said plate 24 such that said platform 32 does not interfere with the rolling of said strap 46.

Figure 4:
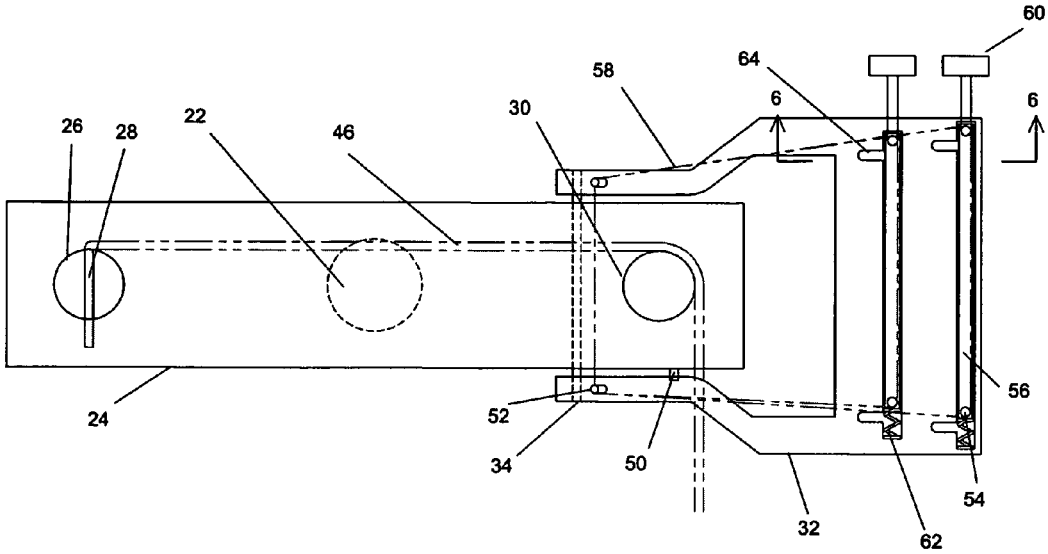
FIG. 4 is side detail view of the tying section of the strap roll up device of the instant invention.

Referring now to FIG. 4, side detail view of the tying section of the strap roll up device of the instant invention is shown. As described above, said platform 32 is rotatably affixed to said plate 24 by a platform pin 34. During the roll up process, said platform 32 is held in position aligned with said plate 24 by means of a securing pin 50 which protrudes from the side of said plate 24 rearward of said platform pin 34 and engages a hole in said platform 32. A pair of forward band pins 52 protrude from the end of said platform 32 between said pin 30 and said split pin 26, with one of the forward band pins 52 on either side of said plate 24. A plurality of pairs of rearward band pins 54 are affixed to an equal number of band axles 56 rotatably affixed to said platform 32 rearward of said pin 30. A plurality of bands 58 may be loaded onto said forward band pins 52 and said rearward band pins 54 starting with the rearwardmost set of said rearward band pins 54. The bands 58 (conventional rubber bands in the preferred embodiment, but any other elastic band may be used) are stretched into the shape of a trapezoid such that the forward ends of said bands 58 fit over said forward band pins 52 and the rearward ends each of said bands 58 are stretched over a pair of said rearward band pins 54. The band axles 56 fit within holes in the interior of said platform 32. Said rearward band pins 54 protrude out from the surface of said platform 32 through a platform slot (not shown in this view). One end of said band axles 56 protrudes beyond said platform 32 and a button 60 is affixed to each of these ends. A spring 62 fits within the hole in said platform 32 opposite each button 60 and presses against the end of said band axle 56 tending to force said band axle 56 in the direction of said button 60. The force of said bands 58 tends to pull said band pins 54 forward, but said band pins 54 engage the forward edge of the slot in said platform 32 which prevents them from rotating forward from the force of said bands 58. A plurality of rearward pin slots 64 are cut from the interior of said platform 32 through the outer surface of said platform 32. There is one of the rearward pin slots 32 for each of said rearward band pins 54 and said rearward pin slots 64 are offset from said rearward band pins 54 in the direction of said springs 62. Thus, if one of said buttons 60 is pushed, the corresponding band axle 56 is pushed toward said spring 62 and offsets the force of said spring 62. Said rearward band pins 54 may then engage said rearward pins slots 64 and rotate forward. This releases said band 58 from said rearward band pins 54.

Figure 5:
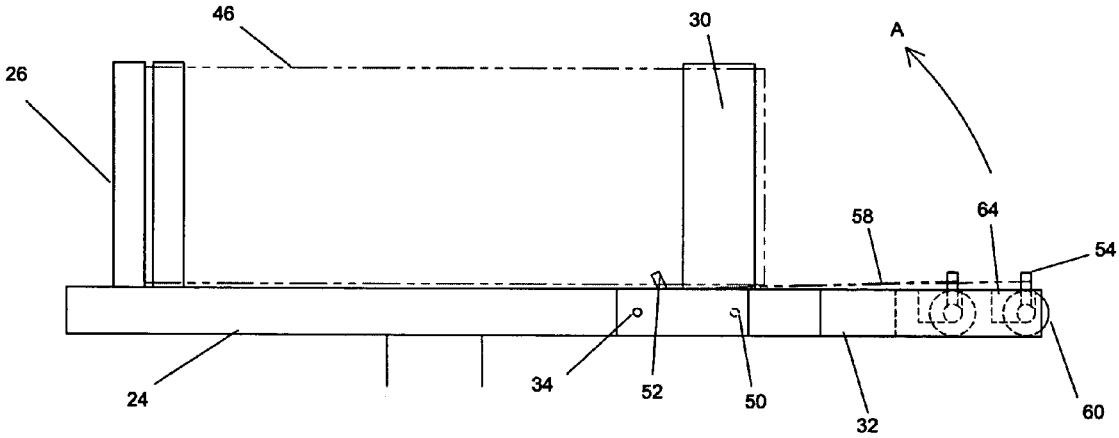
FIG. 5 is a top detail view of a portion of the roll up section of the strap roll up device of the instant invention.

Referring now to FIG. 5, a top detail view of a portion of said roll up section 4 of the strap roll up device of the instant invention is shown. This view shows said strap 46 rolled up around said split pin 26 and said pin 30. Said platform 32 may then be rotated about said platform pin 34 in the direction of arrow A. An easy tug of said platform 32 releases said platform 32 from said securing pin 50. Said platform 32 is rotated until it if roughly perpendicular to said plate 24. Said pin 60 is pushed which allows said rearward band pin 54 to rotate forward into said rearward pin slot 64. This releases said band 58 from said rearward band pins 54 and allows said band 58 to tighten around the rolled up strap 46. Said platform 32 may then be rotated back to its original position aligned with said plate 24. Said strap 46 may then be pulled from said split pin 26 and said pin 30. Said band 58 also pulls off said forward band pins 52. Said strap 46 is now in a tidy elongated roll secured by said band 58. This operation may be repeated as long as there is a band 58 loaded onto said platform 32 starting from the rearwardmost button 60 and moving one of said buttons 60 forward with each rolling and extracting operation.

Figure 6:
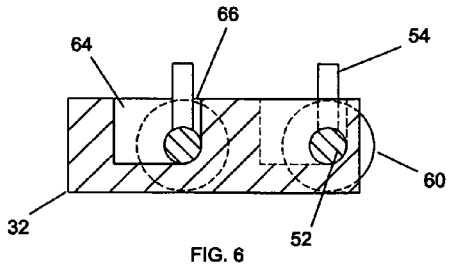
FIG. 6 is a sectional view of the strap roll up device of the instant invention taken along line 6-6 of FIG. 4.

Referring now to FIG. 6, a sectional view of the strap roll up device of the instant invention taken along line 6-6 of FIG. 4 is shown. This view better shows said rearward band pins 54 protruding outward from the surface of said platform 32 through a platform slot 66. In the loaded position (as shown) said rearward band pins 54 engage the lip of the platform slot 66 and may not rotate about said band axles 56. Once said button 60 is pushed, said rearward band pins 54 may engage said rearward pin slots 64 and they are free to rotate forward into said rearward pin slots 64. This has the effect of releasing said bands 58 (not shown) from said rearward band pins 54.

In the preferred embodiment of the strap roll up device of the instant invention, unless otherwise specified; all elements are made from plastic, but other materials having similar strength and weather resistance could be used. Said screw 14 is conventional and made from steel. Said platform pin 34, said securing pin 50, and said band axles 56 are steel. Said springs 62 are conventional.

Although the strap roll up device of the instant invention has been described as being used for rolling tie down straps, the device, with little modification, could be used to roll up and secure any number of long, thin objects.

While preferred embodiments of this invention have been shown and described above, it will be apparent to those skilled in the art that various modifications may be made in these embodiments without departing from the spirit of the present invention.

I claim:

1. A strap roll up device for rolling up and securing in the roll a variety of long, thin objects such as a strap comprising:

a bracket having a forward end and a rearward end;

an axle being rotatably secured near the rearward end of the bracket;

a handle being affixed to one end of the axle such that the handle is capable of being turned to rotate said axle;

a strap plate affixed to the end of said axle opposite said handle such that when said handle is turned said axle and the strap plate rotate; said strap plate having a split pin near one end and a pin near the other end and the split pin having securing means such that a strap is removably affixed to said split pin; and such that said handle is turned and the strap will roll up on said split pin and said pin to form the strap into an elongated roll;

a securing plate rotatably affixed to one end of said strap plate and the securing plate being capable of being rotated such that it is aligned with said strap plate or rotated into a position such that said securing plate encompasses the elongated roll; and said securing plate being constructed such that at least one elastic band is removably secured to said securing plate in a configuration such that the elastic band forms an opening large enough to fit around said elongated roll with said elastic band surrounding said elongated roll and said elastic band is removed from said securing plate such that said elastic band secures said elongated;

whereby a strap is removably affixed to said split pin, said handle is turned, and said strap rolled into an elongated roll around said split pin and said pin, said securing plate is rotated such that said elastic band surrounds said elongated roll, said elastic band removed from said securing plate, and said strap, now secured by said elastic band, removed from the strap roll up device.

2. The strap roll up device of claim 1 in which means is provided for removably affixing the forward end of said bracket to another object to secure the strap roll up device in a stable position for ease of use.

* * * * *